United States Patent [19]

Newberry et al.

[11] Patent Number: 5,033,215

[45] Date of Patent: Jul. 23, 1991

[54] CALENDAR APPARATUS

[76] Inventors: Jack A. Newberry; Robin Newberry, both of 10301 Lupine St., Id. 83704

[21] Appl. No.: 510,098

[22] Filed: Apr. 17, 1990

[51] Int. Cl.[5] ..... G09D 3/02

[52] U.S. Cl. ..... 40/107; 40/158.1; 40/122

[58] Field of Search ..... 40/107, 158.1, 649, 40/359, 360, 160, 120, 121, 122, 611

[56] References Cited

U.S. PATENT DOCUMENTS

| | | | |
|---|---|---|---|
| 1,363,427 | 12/1920 | Melton | 40/107 |
| 1,764,236 | 6/1930 | Abbott | 40/121 |
| 1,765,070 | 6/1930 | Graham | 40/122 X |
| 2,639,531 | 5/1953 | Engemann | 40/158.1 |
| 2,831,285 | 4/1958 | Cross | 40/120 X |
| 2,875,672 | 3/1959 | Cross | 40/158.1 X |
| 2,892,275 | 6/1959 | Woofter | 40/122 |
| 3,605,306 | 9/1971 | Diambra et al. | 40/107 |
| 4,048,740 | 9/1977 | Zitzelberger et al. | 40/158.1 |

*Primary Examiner*—Laurie K. Cranmer
*Assistant Examiner*—J. Bonifanti
*Attorney, Agent, or Firm*—Paul F. Horton

[57] ABSTRACT

Calendar apparatus for displaying a favorite picture, photograph, or other graphic work, in conjunction with a calendar. A rectangular backing member holds pictures, or the like, of varying size and a pair of spaced friction slide members permit the pictures to be displayed artistically by the use of any desired combination of mats, without disassembly of the apparatus. Another friction slide member, located adjacent the bottom edge of the backing member serves to hold the downwardly depending calendar and permits convenient changing of calendar sheets without mutilation of the calendar. The backing member may be provided, on its back surface, with a pocket for holding a variety of mats, photos, and pictures.

9 Claims, 1 Drawing Sheet

CALENDAR APPARATUS

BACKGROUND OF THE INVENTION

1. Field of the Invention

This invention relates in general to display type calendars and, more particularly, to calendars provided with means for changing the artistic display of photographs, pictures, and other graphic works.

2. Description of the Prior Art

It is very common for pictures to be displayed with calendars to make the calendars more attractive. Ordinarily, a single picture may be used the entire year with tear-off calendar sheets. Other calendars display a new picture every month. With such calendars, one, of course, is limited to the particular pictures selected by the manufacturer of the calendar.

To overcome this disadvantage, and to enable one to display the work of their choosing, several inventions have been devised, as typified by U.S. Pat. No. 715,479 issued to F. E. Housh. Housh discloses a frame and calendar having a backing and a mat affixed thereto for displaying a selected picture, advertising devise, or other printed material. Other relevant disclosures are those of Brindly, U.S. Pat. No. 4,276,703; Diambra, U.S. Pat. No. 3,534,489; Jones, U.S. Pat. No. 1,172,606 and Magnus, U.S. Pat. No. 2,010,102.

Common problems of existing photo-calendar devices are the lack of ready access for mounting and removal of pictures of varying dimensions; the inability to accommodate a selected variety of mats of varying colors and textures and having varying sizes and shapes of viewing apertures to obtain a desired affect; the inability to clamp mats so as to maintain rigidity over time and to therefore prevent the sagging of the mats; and the inability to make monthly changes and storage, if desired, of calendar leafs without their mutilation.

SUMMARY OF THE INVENTION

The present invention overcomes these and other problems by providing calendar apparatus having a backing member; picture holding means affixed to the backing member; a pair of oppositely disposed mat holding members; and a calendar holding member. A more thorough description may be seen in the appended claims.

It is therefore a primary object of the present invention to provide calendar apparatus having a reuseable backing member which holds and is refillable with a variety of chosen pictures and photos of varying dimensions.

It is also an object of the present invention to provide calendar apparatus wherein the backing member is slotted for accommodating such pictures and photos.

It is additionally an important object of the present invention to provide calendar apparatus having opposing mat clamping members which permit ready unobstructed access to the picture holding members and yet is operable to hold a plurality of mats of varying characteristics in a clamped position over the photo or picture to maintain the mats in a rigid, non-sagging condition.

Even more specifically, it is an object of the present invention to provide calendar apparatus having opposing mat holding members which provide the appearance of a picture frame, while allowing ready access to an underlying picture by simply sliding mats to and from the holding members.

Additional objects and advantages will become apparent and a more thorough and comprehensive understanding may be had from the following description taken in conjunction with the accompanying drawings forming a part of this specification.

DETAILED DESCRIPTION OF THE INVENTION

Figures 1, 2, 3:
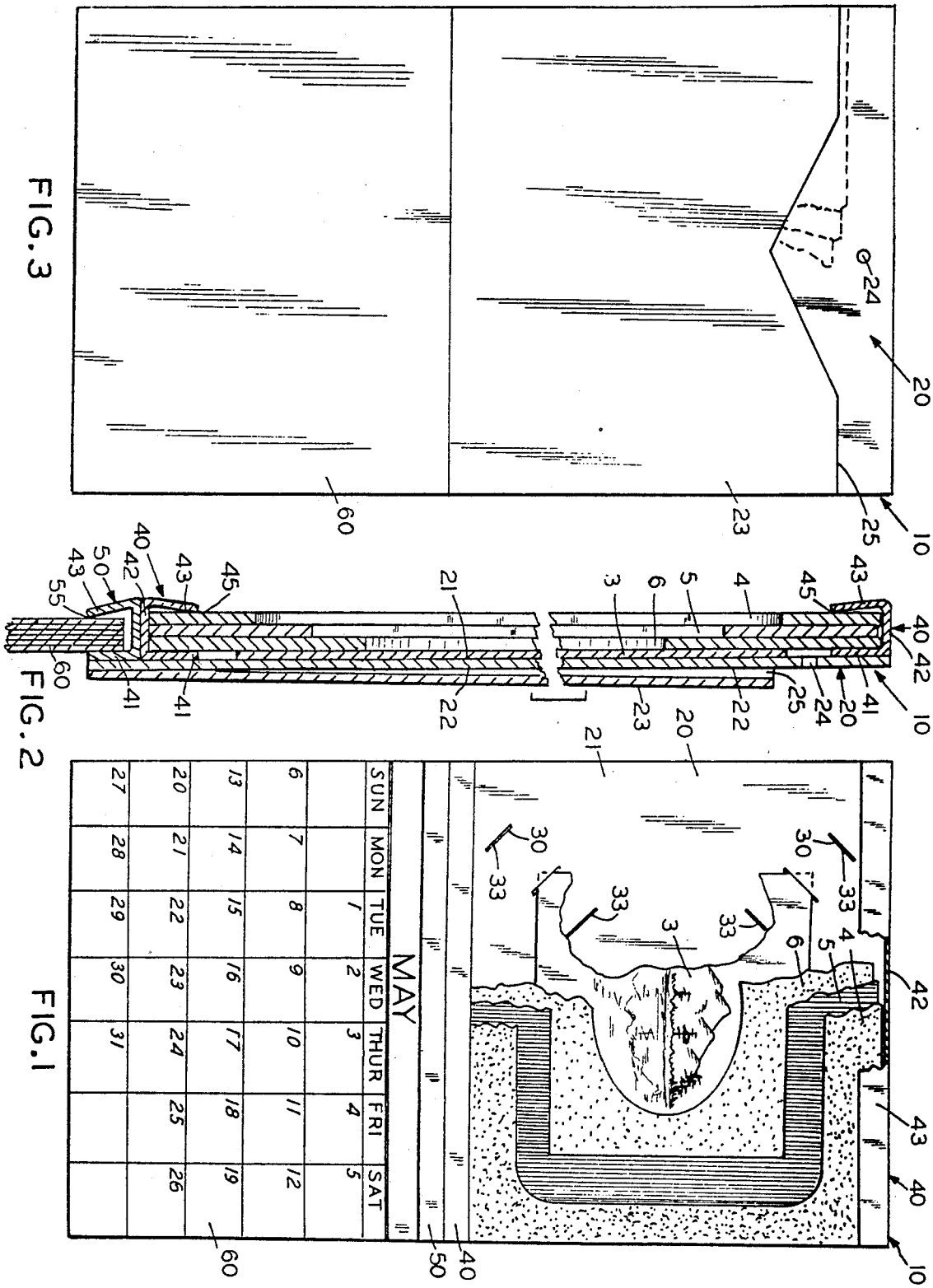
FIG. 1 is a front elevation of a preferred embodiment of the calendar apparatus of the present invention, showing picture and mats in partial section for clarity.
FIG. 2 is a vertical section, enlarged in dimensions for clarity, of the apparatus of FIG. 1.
FIG. 3 is a back elevation of the calendar apparatus shown in FIG. 1.

Referring now to the drawings, an embodiment to be preferred of calendar apparatus 10, made according to the present invention, is disclosed. Calendar apparatus 10 includes, generally, a backing member 20; picture holding members, designated generally by the numeral 30; mat holding members 40; and calendar holding means 50.

Backing member 20, in the embodiment shown, is rectangular and substantially square in shape and is constructed of any suitable material, as for example cardboard or plastic. It is preferred that the material be of rigid or semi-rigid construction for proper support of other elements and have planar opposing surfaces, including a front surface 21 and a back surface 22. The back surface includes a suitable wall mounting means 24 in the form of an aperture, shown, or common fasteners, not shown. On the back surface is affixed a sheet 23 of material, preferably of the same composition as the backing member to define a top opening pocket 25 for holding mats, photos, and pictures. The term "picture" herein and in the appended claims is considered to include the conventional definition as well as photographs, designs, and other like graphic materials.

Picture holding members 30 are, in the embodiment shown, defined by at least two and preferably four sets of slits 33 cut in the front surface of backing member 20. The slits are diagonally spaced from one another for holding pictures of varying size by insertion of picture corners into diagonally opposed slits. Obviously, other fasteners mounted on the front surface of the backing member would also suffice.

Mat holding members 40 are preferably constructed of elongated spring metal or plastic clamps of modified C-shaped construction in cross section, and as shown to advantage in FIG. 2. Each member is identical, including a back side 41 glued or otherwise affixed to the front surface of backing member 20; a front side 43 operable to engage the mats; and an end piece 42 connecting the front and back sides of the member together in clamping relationship. Each member 40 defines a front opening slot 45 into which mats may be slid. The mats are held in place by the frictional and clamping engagement of the member. The two holding members 40 may be affixed in horizontally and parallel spaced relationship to one another adjacent the top and bottom edge of backing member 20 with slots 45 facing one another. Members 40 may also be placed adjacent the vertical edges of the backing rather than the top and bottom edges as shown. Horizontal placement prevents any accidental slippage during placement of the mats. It is obvious that the mat holding members are not restricted to holding mats, though designed and intended for this purpose, but may also hold large pictures of or cut to appropriate size and/or a clear plastic cover for protecting underlying pictures and mats.

Calendar holding means, designated by the numeral 50 is identical in construction to each of the mat holding members 40 and therefore the description relating to the mat holding members should suffice. Holder 50 is horizontally affixed to backing member 20 at the lowermost edge of the backing member. In the embodiment shown, holder 50 is located immediately below the lowermost mat holding member 40. Slot 55 of holder 50 opens downwardly to receive and hold downwardly depending calendar 60, or sheets thereof, as shown.

Referring now to FIGS. 1 and 2, mounting of a picture 3 with mats 4, 5, and 6, having different viewing apertures for artistic effect, may be clearly seen. Picture 3 is first placed on the front surface 21 of backing member 20 with the corners of the picture being inserted into slits 33. The picture may require trimming to the appropriate dimensions if oversized. Next, a desired number of mats may be inserted into respecting facing slots 45 of the two opposing holding members 40 by sliding the mats into the slots from either side, where they are held in place by the clamping action of the mat holding members. It will be noted that the mats are held in the same position and under the constant tension initially applied to the mats in their extension between opposing holding members. In this manner, the mats are prevented from sagging or shifting. In the illustration in FIG. 1, a first mat 6, having perhaps an oval aperture, as shown, is inserted to show a selected portion of picture 3. Next, a second mat 5 is mounted over the first mat with the aperture of the second mat exposing a selected portion of the first mat. Finally, a third mat 4 is mounted over the second mat and, again, the aperture of the third mat exposes a selected portion of the second mat. Obviously, the mats may be stacked and inserted together as a unit into holders 40. The mats may be of any desired color and texture and any single mat may include differing color and texture on its opposite sides. Additionally, each mat may have apertures of selected sizes and shapes for creating a large number of artistic effects. Finally, if desired, a clear plastic sheet, not shown, may be inserted into holders 40 over the underlying mats and picture for protection.

A conventional calendar having a spiral wire, staples, or the like, for holding individual leaves, may be slid into frictional and clamping engagement within slot 55 of calendar holder 50. In the alternative, any number of individual calendar leaves, unbound, may be clamped together by means of holder 50 and individually removed, as time goes by, without mutilation of the leaves. The leaves, which often serve as memos, may be stacked behind one another for storage or may be placed in pocket 25 on the back of apparatus 10, as desired.

Having thus described in detail a preferred embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. Calendar apparatus comprising:

a rectangular backing member having a front surface and a back surface;

a plurality of spaced picture holding members on the front surface of said backing member;

a pair of mat holding members, each of said mat holding members affixed to the front surface of said backing member adjacent opposing edges thereof; each of said mat holders comprising an elongated friction slide clamp defining a slot facing the opposing clamp slot for slidingly receiving at least one mat therein to hold said mat in a taut position; and calendar holding means affixed to said backing member adjacent the lowermost edge thereof for hanging a calendar therefrom.

2. The apparatus as described in claim 1 wherein said picture holding members comprise a plurality of longitudinal slits in said backing member, said slits diagonally spaced from respective slits for receiving a portion of a picture therein.

3. The apparatus as described in claim 1 wherein one of said elongated clamps is horizontally mounted adjacent the top edge of said backing member and the opposing slide clamp is mounted adjacent the lower edge of said backing member.

4. The apparatus as described in claim 1 wherein said calendar holding means include an elongated friction slide clamp defining a downwardly opening slot for slidingly receiving and dispensing a calendar placed therein without mutilation of the calendar.

5. The apparatus as described in claim 1 wherein said backing member is provided with wall mounting means.

6. The apparatus as described in claim 1 further comprising a pocket mounted on the back surface of said backing member.

7. Calendar apparatus comprising:

a rectangular backing member having a front surface and a back surface;

a plurality of picture holding members on the front surface of said backing member for readily accessible exchange of pictures;

a pair of mat holding members, each of said mat holding members comprising an elongated friction slide clamp affixed to the front surface of said backing member adjacent opposing horizontal edges thereof for readily accessible exchange of mats;

wall mounting means on said backing member; and calendar holding means affixed to said backing member adjacent the lowermost edge thereof for hanging a calendar therefrom.

8. The apparatus in claim 7 wherein said picture holding members comprise a plurality of longitudinal slits in said backing member, said slits diagonally spaced from respective slits for receiving a portion of a picture therein.

9. The apparatus as described in claim 7 further comprising a pocket mounted on the back surface of said backing member.

* * * * *